US008925528B2

(12) United States Patent
Kach et al.

(10) Patent No.: US 8,925,528 B2
(45) Date of Patent: Jan. 6, 2015

(54) ENGINE BALANCING SUPERCHARGER

(75) Inventors: Ray Alan Kach, Farmington Hills, MI (US); Michael Bruno Magnan, Dearborn, MI (US); Robert Andrew Wade, Dearborn, MI (US); Vince Paul Solferino, Dearborn, MI (US); David E. Masser, Dearborn Heights, MI (US); Jeffrey Eliot Chottiner, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 41 days.

(21) Appl. No.: 13/533,199

(22) Filed: Jun. 26, 2012

(65) Prior Publication Data

US 2013/0340726 A1 Dec. 26, 2013

(51) Int. Cl.
*F02B 33/00* (2006.01)

(52) U.S. Cl.
USPC ..... 123/559.1; 123/559.3; 123/564; 123/561; 60/605.1; 60/611

(58) Field of Classification Search
USPC ..... 123/559.1, 196, 192.2, 193.2, 559.3, 123/68, 561, 564; 60/605.1, 611; 418/203, 418/206.1
See application file for complete search history.

(56) References Cited

U.S. PATENT DOCUMENTS

| | | | | |
|---|---|---|---|---|
| 4,072,447 | A * | 2/1978 | Gaspar | 418/36 |
| 5,121,733 | A * | 6/1992 | Goto et al. | 123/559.1 |
| 6,055,967 | A * | 5/2000 | Miyagi et al. | 123/564 |
| 6,189,499 | B1 * | 2/2001 | Iwata et al. | 123/192.2 |
| 6,439,188 | B1 * | 8/2002 | Davis | 123/193.2 |
| 6,453,890 | B1 * | 9/2002 | Kageyama et al. | 123/559.1 |
| 7,621,263 | B2 * | 11/2009 | Eybergen et al. | 123/559.3 |
| 8,539,769 | B2 * | 9/2013 | Hansen et al. | 60/611 |
| 2011/0085924 | A1 * | 4/2011 | Shampine et al. | 417/321 |
| 2012/0090319 | A1 * | 4/2012 | Mond et al. | 60/609 |

* cited by examiner

*Primary Examiner* — Thomas Denion
*Assistant Examiner* — Thomas Olszewski
(74) *Attorney, Agent, or Firm* — James Dottavio; Alleman Hall McCoy Russell & Tuttle LLP

(57) ABSTRACT

An engine is provided. The engine includes a piston operable to reciprocate in a cylinder, a crankshaft rotatably coupled to the piston, and a supercharger rotatably coupled to the crankshaft. The supercharger has an unequal distribution of mass along a longitudinal plane of the supercharger to provide a rotational counterbalance to reduce engine imbalance.

15 Claims, 7 Drawing Sheets

ENGINE BALANCING SUPERCHARGER

BACKGROUND AND SUMMARY

Various types of engines produce vibration due to any unbalanced forces in their design. For example, such vibration may be generated because of the reciprocating motion of the connecting rods and pistons. In particular, during a given period of crankshaft rotation, descending and ascending pistons may not be completely opposed in their acceleration, giving rise to a net inertial force that creates an unbalanced vibration. Such vibration may reduce the drivability of a vehicle and may be negatively perceived by a vehicle operator.

In one example, an engine may include a balance shaft system that includes counter-rotating balance shafts. The balance shafts may have counterweights that are sized and phased so that the inertial reaction to their counter-rotation provides a net force equal to but opposing the undesired vibration of the engine, thereby canceling it. However, the inventors herein have recognized issues with the above approach.

For example, the balance shaft system may add cost and weight to the engine. Moreover, operation of the balance shafts system may cause friction losses that negatively impact engine power and fuel economy.

Thus, in one example, the above issues may be addressed by an engine comprising: a piston operable to reciprocate in a cylinder, a crankshaft rotatably coupled to the piston, and a supercharger rotatably coupled to the crankshaft, the supercharger having an unequal distribution of mass along a longitudinal plane of the supercharger to provide a rotational counterbalance to reduce the inherent engine unbalance.

In one example, the supercharger includes two counter-rotating rotors arranged in the longitudinal plane of the supercharger to increase intake air charge pressure provided to the cylinder. One or both of the rotors may be configured such their mass is unequally distributed to provide a rotational counterbalance or rotation couple that opposes vibration of the engine. In this way, engine vibration may be reduced without the use of a separate balance shaft system. By adding balancing functionality to the supercharger weight, cost, friction, and package space of the engine may be reduced relative to an engine that employs a balance shaft system.

Moreover, the supercharger may be mounted to the engine in different locations with the rotors parallel to the crankshaft, yet still provide the rotational counterbalance to reduce the inherent imbalance of the engine. In this way, the supercharger may provide greater engine packaging flexibility relative to a balance shaft system.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present description relates to reducing engine vibration in a vehicle due to the engine being inherently unbalanced. More particularly, the present disclosure relates to a supercharger having an unequal distribution of mass along a longitudinal plane of the supercharger to provide a rotational counterbalance to reduce the inherent engine imbalance. By providing engine imbalance reducing functionality in the supercharger, an engine may be substantially balanced without the use of a balance shaft system.

Figure 1:
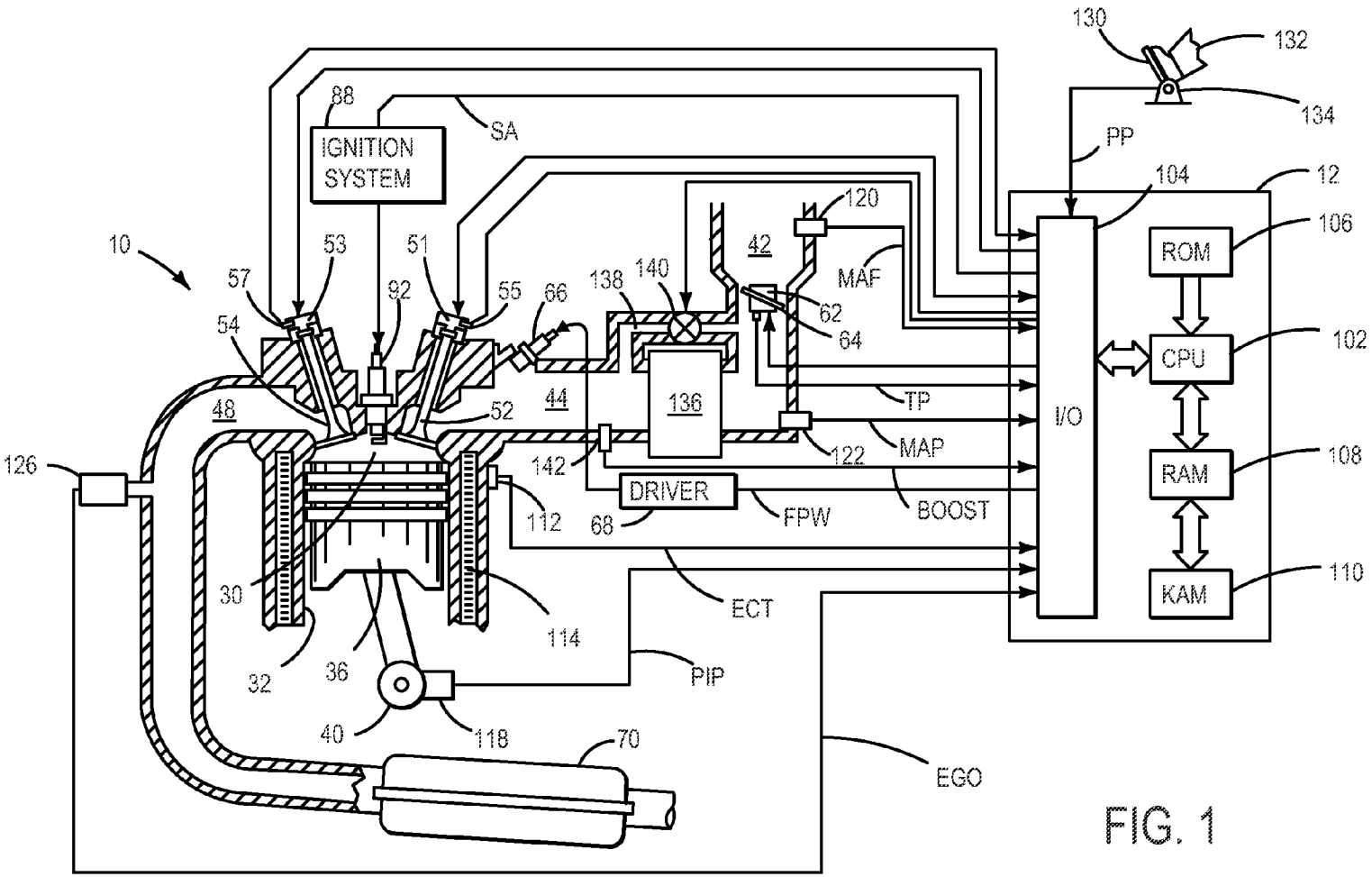
FIG. 1 schematically shows an example of an engine according to an embodiment of the present disclosure.

FIG. 1 is a schematic diagram showing one cylinder of multi-cylinder engine 10, which may be included in a propulsion system of an automobile. Engine 10 may be any suitable engine having any suitable unbalanced vibration characteristics without departing from the scope of the present disclosure. For example, engine 10 may be a 90° or 60° V6 engine that produces both a $1^{st}$ and $2^{nd}$ order rotating couple. As yet another example, engine 10 may be an in-line 3 cylinder engine that produces a planar $1^{st}$ order couple. As yet another example, engine 10 may be an in-line 4 cylinder engine that produces a $2^{nd}$ order vertical shaking force. As yet another example, engine 10 may be a 90° V8 engine that produces a $2^{nd}$ order lateral couple. Note that a $1^{st}$ order force occurs once per crankshaft rotation and a $2^{nd}$ order force occurs twice per crankshaft.

Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via electric valve actuator (EVA) 51. Similarly, exhaust valve 54 may be controlled by controller 12 via EVA 53. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown arranged in intake manifold 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Supercharger 136 may be arranged along intake passage 44 to increase air charge density and pressure in intake manifold 44. A boost sensor 142 may be positioned in intake manifold 44 downstream of supercharger 136 to provide an indication of boost pressure. In addition to providing intake air charge compression functionality, supercharger 136 has an unequal distribution of mass along a longitudinal plane of the supercharger. The unequal distribution of mass may provide a rotational counterbalance during operation of the supercharger to reduce engine imbalance. In some embodiments, supercharger 136 has an unequal distribution of mass along the longitudinal plane of the supercharger to provide a shaking counterbalance during operation of the supercharger to reduce the inherent engine imbalance. Various arrangements of the supercharger for providing counterbalance to reduce the inherent engine imbalance will be discussed in further detail below with reference to FIGS. 4-11.

In some embodiments, supercharger 136 may be rotatably coupled to crankshaft 40 such that supercharger 136 may be at least partially driven by rotation of crankshaft 40. In some embodiments, supercharger 136 may be at least partially driven by an electric machine (not shown).

Supercharger 136 may be driven at different speeds relative to crankshaft rotation, depending on the type of engine configuration and corresponding crankshaft vibration characteristics (e.g., $1^{st}$ order force, $2^{nd}$ order force, etc.). For example, supercharger 136 may be operated at a 1:1 drive ratio with crankshaft 40 to counteract $1^{st}$ order forces produced by crankshaft vibration. In other words, the supercharger may be operated at the same speed as the crankshaft. In another example, supercharger 136 may be operated at a 2:1 drive ratio with crankshaft to counteract $2^{nd}$ order forces produced by crankshaft vibration. In other words, the supercharger may be operated at twice the speed of the crankshaft.

In some embodiments, because supercharger 136 is a positive displacement pump that is rotatably coupled with and driven by crankshaft 40, supercharger 136 may be continuously operating during engine operation to provide boost pressure at all driving conditions. However, in some conditions, increased boost pressure may not be desirable. For example, during a low engine load condition such as at idle or at light throttle cruising, increased boost pressure may increase pumping work to push air into intake manifold 44 and cylinder 30 and correspondingly may increase pumping losses that lower engine efficiency and fuel economy.

Engine 10 includes a bypass passage 138 fluidly coupled between a point downstream of supercharger 136 in intake manifold 44 and a point upstream of the supercharger 136 in air inlet 42 that is downstream of throttle 62. Bypass passage 138 allows air to flow from intake manifold 44 to a point upstream of an inlet of supercharger 136 in air inlet 42 in order to reduce or minimize pumping work. In other words, bypass passage 138 allows air to be recirculated from downstream of the supercharger to upstream of the super charger to reduce boost pressure in the intake manifold.

Bypass valve 140 is positioned in bypass passage 138. Bypass valve 140 may be operable to selectively allow air to flow from intake manifold 44 downstream of supercharger 136 to air inlet 42 upstream of supercharger 136. Bypass valve 140 may be controlled by controller 12 to lower boost pressure during specific operating conditions including during low engine load conditions. In particular, controller 12 may be configured to vary an opening position of bypass valve 140 to vary an amount of air flow through bypass passage 138 in order to adjust a boost pressure downstream of the supercharger to a commanded pressure. Thus, the amount of compression provided to one or more cylinders of the engine via supercharger 136 may be varied by controller 12. Moreover, the pumping effort of supercharger 136 may be reduced by opening bypass valve 140, thereby increasing fuel efficiency of engine 10 during low engine load conditions. Supercharger 136 may continue operation even when bypass valve 140 is open to provide engine balancing functionality.

In some embodiments, supercharger 136 may not be decoupled from crankshaft 40 during operation of crankshaft 40, such as via a clutch or other decoupling mechanism. As such, supercharger 136 may provide balancing functionality while crankshaft 40 is rotating.

In some embodiments, controller 12 may adjust one or more engine actuators responsive to a low engine load condition when bypass valve 140 is opened to compensate for air flow being routed from intake manifold 44 to the inlet of supercharger 136. For example, controller 12 may adjust engine torque by adjusting the spark timing (e.g., retarding spark) of ignition system 88. In another example, controller 12 may adjust the air/fuel ratio by adjusting a fuel injection amount injected by injector 66. Such actuator may be adjusted to compensate for the lowered boost pressure relative to other operating conditions.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; boost pressure in the intake manifold (BOOST) from pressure sensor 142; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Computer readable medium read-only memory 106 can be programmed with computer readable data representing instructions executable by processor 102 for performing the methods described below as well as other variants that are anticipated but not specifically listed. As described above, FIG. 1 shows only one cylinder of a multi-cylinder engine, and that each cylinder may similarly include its own set of intake/exhaust valves, fuel injector, spark plug, etc.

Figure 2:
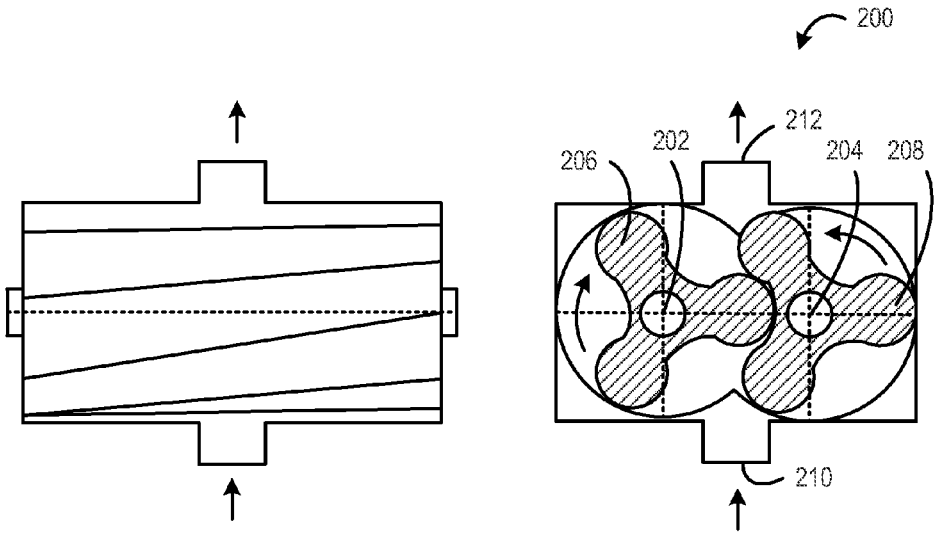
FIG. 2 shows a cross-section of an example of a Roots-type supercharger according to an embodiment of the present disclosure.

FIG. 2 shows a cross-section of an example of a Roots-type supercharger 200 according to an embodiment of the present disclosure. In one example, supercharger 200 may be implemented as supercharger 136 shown in FIG. 1. Supercharger 200 includes two counter rotating synchronized rotors 202 and 204. In other words, a first rotor 202 rotates in an opposite direction of a second rotor 204. First rotor 202 and second rotor 204 are positioned parallel in a longitudinal plane of supercharger 200. First rotor 202 includes a first set of lobes 306 and second rotor 204 includes a second set of lobes 208. In the illustrated embodiment, the first set of lobes and the second set of lobes each include three lobes; although it will be appreciated that any suitable number of lobes may be included in the set without departing from the scope of the present disclosure. First set of lobes 206 and second set of lobes 208 mesh during rotation of first rotor 202 and second rotor 204 to compress intake air. In particular, air flows through an inlet 210 and is trapped in pockets surrounding the first and second lobes 206 and 208. As first and second rotors 202 and 204 rotate, the pockets shrink and the trapped air becomes compressed. Eventually, the compressed air is released to an outlet 212. In this supercharger configuration, inlet 210 and outlet 212 are located on opposing sides of the supercharger that are perpendicular to the axes of the first and second rotors such that air flows perpendicular to or across the rotors.

Figure 3:
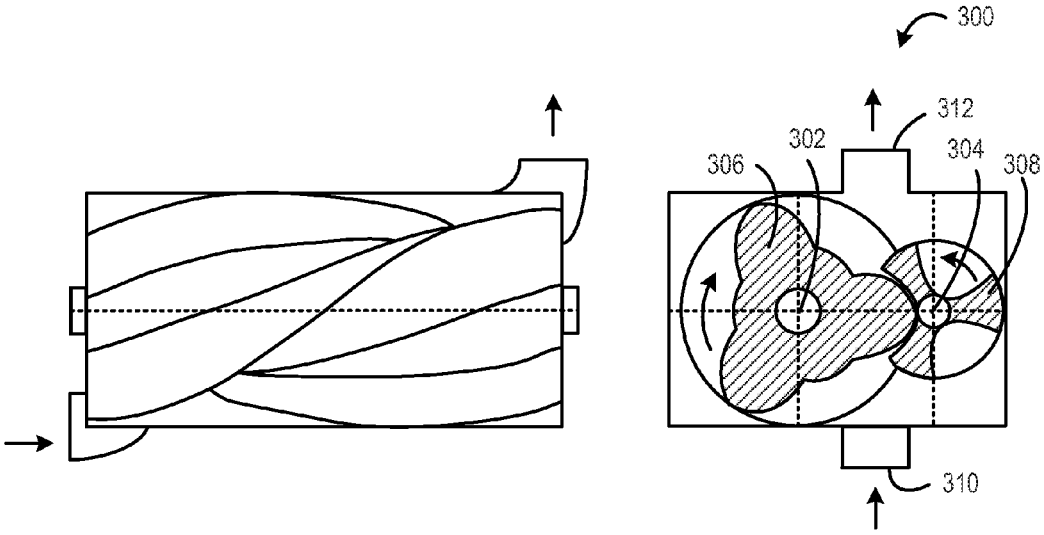
FIG. 3 shows a cross-section of an example of a Lysholm-type supercharger according to an embodiment of the present disclosure.

FIG. 3 shows a cross-section of an example of a Lysholm-type supercharger 300 according to an embodiment of the present disclosure. In one example, supercharger 300 may be implemented as supercharger 136 shown in FIG. 1. Supercharger 300 includes two counter rotating synchronized rotors 302 and 304. In other words, a first rotor 302 rotates in an opposite direction of a second rotor 304. First rotor 302 and second rotor 304 are positioned parallel in a longitudinal plane of supercharger 300. First rotor 302 includes a set of male lobes 306 and second rotor 304 includes a set of female lobes 308. As the first and second rotors and rotate, a female lobe of the second rotor accepts a male lobe of the first rotor to compress intake air. In particular, air flows through an inlet 310 and is trapped in pockets surrounding the first and second lobes 306 and 308. As first and second rotors 302 and 304 rotate, the pockets shrink and the trapped air becomes compressed. Eventually, the compressed air is released to an outlet 312. The male/female lobe design provides gradual compression of entrapped air prior to exposure to high pressure air at the discharge port. In this supercharger configuration, inlet 310 and outlet 312 are located on opposing sides of the supercharger that are parallel to the axes of the first and second rotors such that air flow along or parallel with the rotors.

Figure 4:
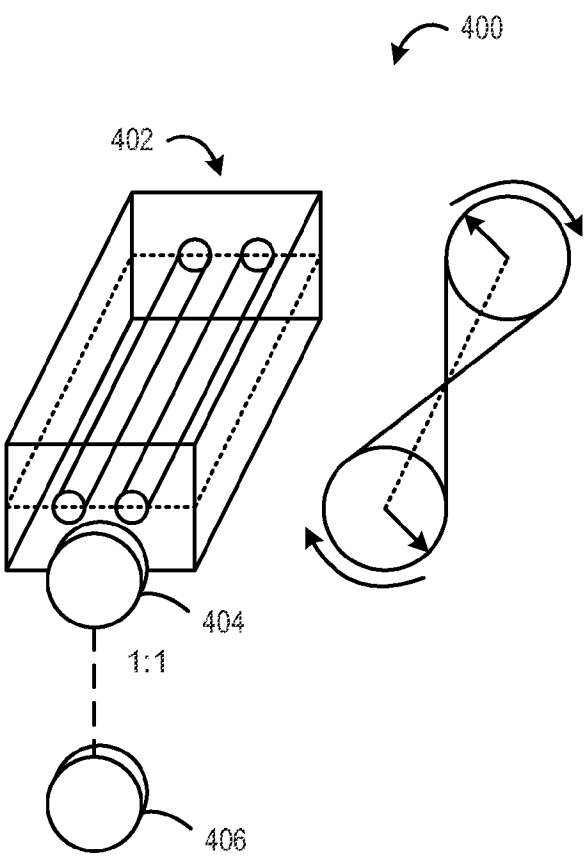
FIG. 4 schematically shows an example of a supercharger operable to provide a $1^{st}$ order rotation couple.

FIGS. 4-7 schematically show various arrangements of a supercharger to provide different types of counterbalance to reduce engine imbalance. FIG. 4 schematically shows an example of a supercharger 400 operable to provide a $1^{st}$ order rotation couple or rotational counterbalance. In particular, supercharger 400 includes two counter-rotating rotors 402 having an unequal distribution of mass in the longitudinal plane of supercharger 400 that provides a rotation couple during operation of supercharger 400. In one example, a centerline of each of rotors 402 is coplanar with the longitudinal plane of supercharger 400. Rotors 402 are coupled to a synchronizing gear set 404 that is further coupled to a crankshaft 406. Rotors 402 are arranged parallel with crankshaft 406. Synchronizing gear set 404 is arranged such that rotors 402 rotate at a 1:1 ratio with crankshaft 406 to provide a $1^{st}$ order rotation couple. In other words, the rotation couple occurs once per crankshaft rotation. In one example, supercharger 400 may provide a $1^{st}$ order rotation couple that reduces the unbalance force in a 90° or 60° V6 engine.

Figure 5:
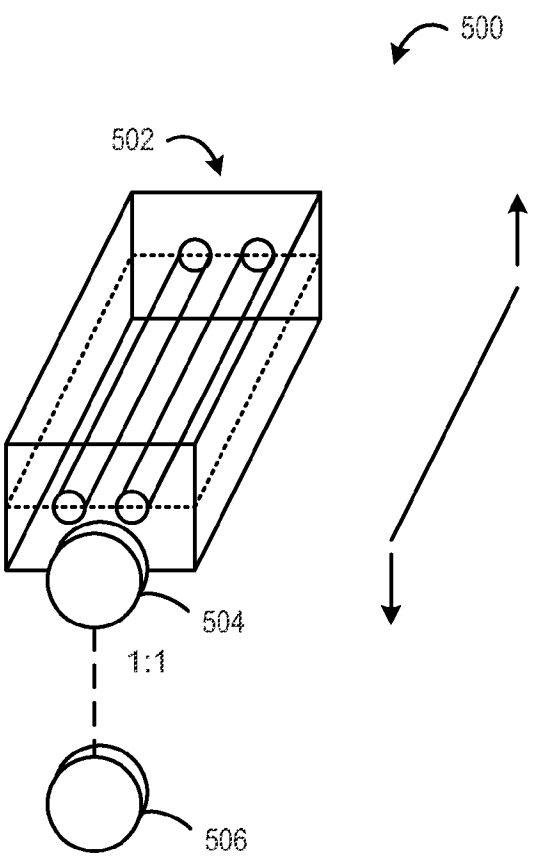
FIG. 5 schematically shows an example of a supercharger operable to provide a $2^{nd}$ order rotation couple.
Figure 6:
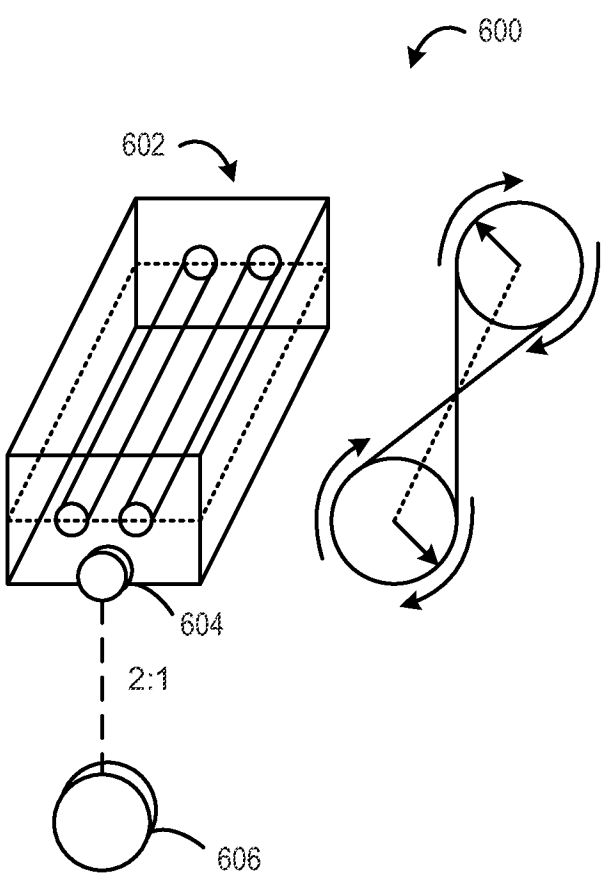
FIG. 6 schematically shows an example of a supercharger operable to provide a $2^{nd}$ order lateral couple.

FIG. 5 schematically shows an example of a supercharger 500 operable to provide a $1^{st}$ order planar couple. In particular, supercharger 500 includes two counter-rotating rotors 502 having an unequal distribution of mass in the longitudinal plane of supercharger 500 that provides a vertical planar couple during operation of supercharger 500. In one example, a centerline of each of rotors 502 is coplanar with the longitudinal plane of supercharger 500. Rotors 502 are coupled to a synchronizing gear set 504 that is further coupled to a crankshaft 506. Rotors 502 are arranged parallel with crankshaft 506. Synchronizing gear set 504 is arranged such that rotors 502 rotate at a 1:1 ratio with crankshaft 506 to provide a $1^{st}$ order vertical planar couple. In other words, the rotation couple occurs once per crankshaft rotation. In one example, supercharger 500 may provide a $1^{st}$ order vertical planar couple that reduces the imbalance force in an in-line 3 cylinder engine. FIG. 6 schematically shows an example of a supercharger 600 operable to provide a $2^{nd}$ order rotation couple. In particular, supercharger 600 includes two counter-rotating rotors 602 having an unequal distribution of mass in the longitudinal plane of supercharger 600 that provides a rotation couple during operation of supercharger 600. In one example, a centerline of each of rotors 602 is coplanar with the longitudinal plane of supercharger 600. Rotors 602 are coupled to a synchronizing gear set 604 that is further coupled to a crankshaft 606. Rotors 602 are arranged parallel with crankshaft 606. Synchronizing gear set 604 is arranged such that the rotors 602 rotate at a 2:1 ratio with the crankshaft 606 to provide a $2^{nd}$ order rotation couple. In other words, the rotation couple occurs twice per crankshaft rotation. In one example, supercharger 600 may be implemented in a 60° or 90° V6 engine that produces a $2^{nd}$ order rotation couple to reduce inherent engine imbalance.

Figure 7:
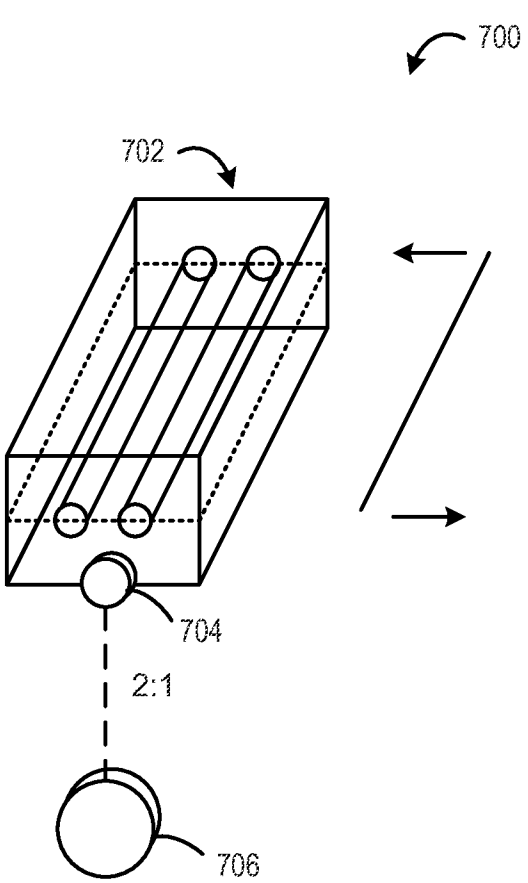
FIG. 7 schematically shows an example of a supercharger operable to provide a $1^{st}$ order planar couple.

FIG. 7 schematically shows an example of a supercharger 700 operable to provide a $2^{nd}$ order lateral couple. In particular, supercharger 700 includes two counter-rotating rotors 702 having an unequal distribution of mass in the longitudinal plane of supercharger 700 that provides a lateral couple during operation of supercharger 700. In one example, a centerline of each of rotors 702 is coplanar with the longitudinal plane of supercharger 700. Rotors 702 are coupled to a synchronizing gear set 704 that is further coupled to a crankshaft 706. Rotors 702 are arranged parallel with crankshaft 706. Synchronizing gear set 704 is arranged such that the rotors 702 rotate at a 2:1 ratio with the crankshaft 706 to provide a $2^{nd}$ order lateral couple. In other words, the lateral couple occurs twice per crankshaft rotation. In one example, supercharger 700 may be implemented in a 90° planar crank V8 engine that produces a $2^{nd}$ order lateral couple. Supercharger 700 may provide a $2^{nd}$ order lateral couple that opposes the $2^{nd}$ order lateral couple provided by the engine to reduce inherent engine imbalance.

It will be appreciated that one or more of the rotation or planar couples described above may be combined in the same supercharger arrangement to reduce inherent engine imbalance. Furthermore, it will be appreciated that the uneven distribution of mass along the longitudinal plane of the supercharger that creates the rotation or planar couple may be achieved through various arrangements without departing from the scope of the present disclosure. Some example mass distribution arrangements in a supercharger are described in further detail below with reference to FIGS. 8-11.

Figures 8, 9, 10, 11:
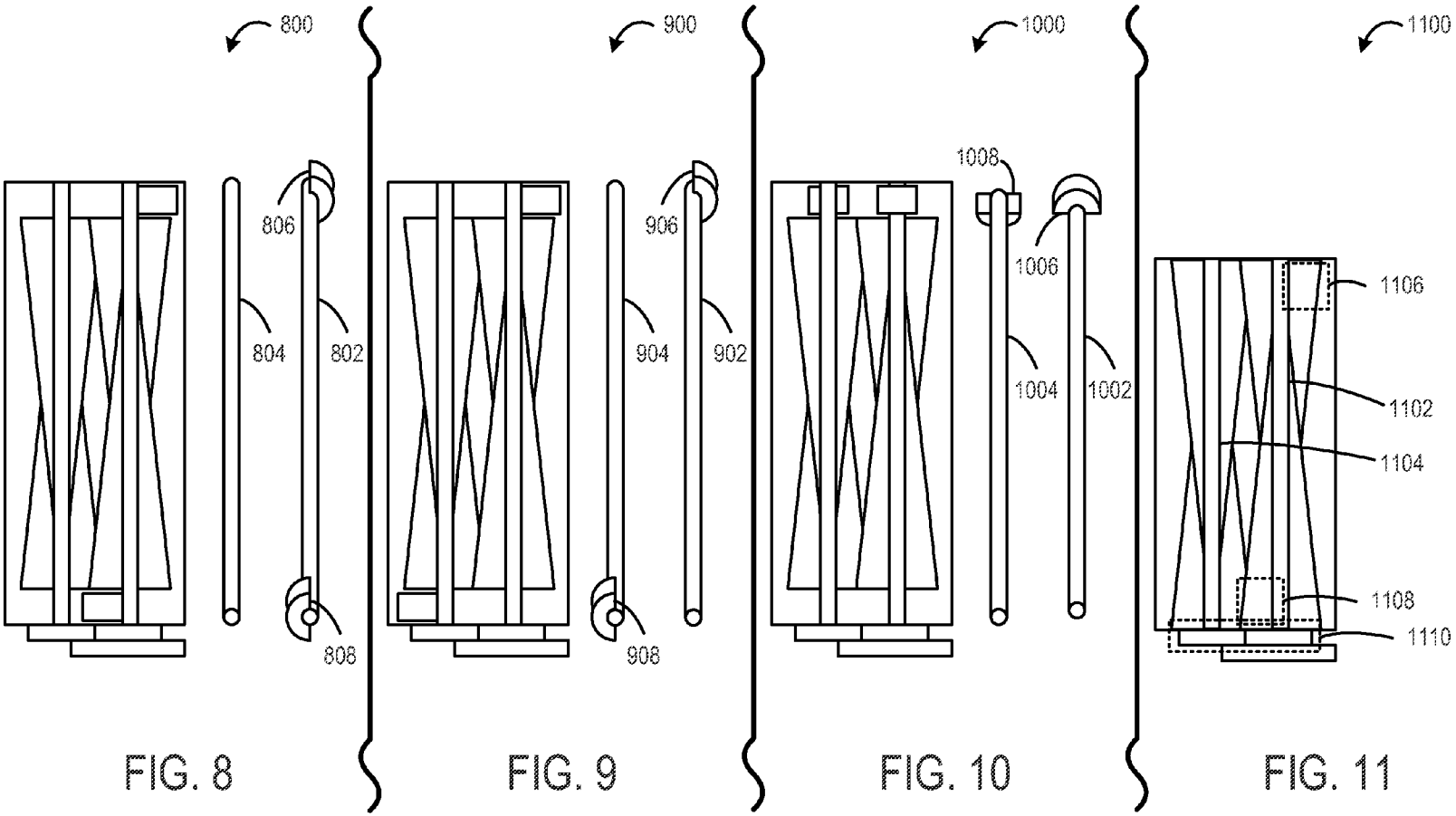
FIGS. 8-11 show different examples of an unequal distribution of mass in a longitudinal plane of a supercharger.

FIG. 8 shows a longitudinal cross-section of an example of an unequal distribution of mass in a longitudinal plane of a supercharger 800 that provides a rotation couple. Furthermore, for ease of recognition, rotors and counterweights of supercharger 800 are shown separately. Supercharger 800 includes a first rotor 802 and a second rotor 804 operable to rotate in an opposite direction of first rotor 802. A first counterweight 806 is located on a first end of first rotor 802 and a second counterweight 808 that opposes first counterweight 806 is located on a second end of first rotor 802 that opposes the first end. In other words, the first and second counterweights are coupled to opposing ends of the same rotor. The counterweights each produce an opposing rotating force. The separation of the counterweights along the first rotor results in a rotation couple that may be used to reduce the inherent engine imbalance. In the illustrated embodiment, the unequal distribution of mass in the longitudinal plane of supercharger 800 may be asymmetrically distributed between the first and second rotors. In particular, since the counterweights are positioned on first rotor 804 and not on second rotor 806, the mass of supercharger 800 may be asymmetrically distributed in favor of the first rotor. It will be appreciated that both the counterweights may be positioned on either the first or second rotor without departing from the scope of the present disclosure. In some embodiments, both counterweights may be positioned on the same rotor and no counterweights may be positioned on the other rotor.

FIG. 9 shows a longitudinal cross-section of another example of an unequal distribution of mass in a longitudinal plane of a supercharger 900 that provides a rotation couple. Furthermore, for ease of recognition, rotors and counterweights of supercharger 900 are shown separately. Supercharger 900 includes a first rotor 902 and a second rotor 904 operable to rotate in an opposite direction of first rotor 902. A first counterweight 906 is located on a first end of first rotor 902 and a second counterweight 908 that opposes first counterweight 906 is located on a second end of second rotor 704 that opposes the first end. In other words, the first and second counterweights are coupled to opposing ends of different rotors. The counterweights each produce an opposing rotating force. The separation of the counterweights along the first and second rotors results in a rotation couple that may be used to reduce the inherent engine imbalance. In some embodiments, each rotor may only include one counterweight. In other words, if a rotor includes a counterweight positioned on one end, then the opposing end of the rotor may not include another counterweight.

FIG. 10 shows a longitudinal cross-section of an example of an unequal distribution of mass in a longitudinal plane of a supercharger 1000 that provides a shaking force. Furthermore, for ease of recognition, rotors and counterweights of supercharger 1000 are shown separately. Supercharger 1000 includes a first rotor 1002 and a second rotor 1004 operable to rotate in an opposite direction of first rotor 1002. A first counterweight 1006 is located on a first end of first rotor 1002 and a second counterweight 1008 that opposes first counterweight 1006 is located on second rotor 1004 at the same end. In other words, the first and second counterweights are coupled to the same end of different rotors. The counterweights are positioned relative to each other such that during rotation of the rotors their vertical forces cancel each other out, and their lateral forces combine to provide an oscillating force that is perpendicular to the plane of the two rotors. The plane of force provided by the counterweights may be coincident with the unbalanced force created by the engine reciprocating components in order to reduce engine imbalance. In some embodiments, each rotor may include only one counterweight. In other words, if a rotor includes a counterweight positioned on one end, then the opposing end of the rotor may not include another counterweight. It will be appreciated that both counterweights may be positioned on either end of the rotors or anywhere in between without departing from the scope of the present disclosure. Furthermore, although the illustrated counterweights may provide a lateral shaking force, in some embodiments, the counterweights may be arranged to provide a planar couple that is perpendicular to the lateral shaking couple.

It will be appreciated that the above described counterweights may be a suitable size and shape to provide a particular type of couple (e.g., planar, rotation, etc.). In some cases, the length of the rotors may be increased and the mass of the counterweights may be reduced to provide the same rotation couple as a supercharger having shorter rotors and heavier counterweights.

FIG. 11 shows a longitudinal cross-section of another example of an unequal distribution of mass in a longitudinal plane of a supercharger 1100. Supercharger 1100 includes a first rotor 1102 and a second rotor 1104 operable to rotate in an opposite direction of first rotor 1102. A material density of first rotor 1102 or second rotor 1104 may be varied to provide an unequal distribution of mass that causes a counterbalance force or couple during rotation of the rotors. In the illustrated embodiment, first portion 1106 and second portion 1108 of first rotor may be denser than the other portions of first rotor 1102. The separation of the higher density portions along the first rotors results in a rotation couple that may be used to reduce the inherent engine imbalance. By varying the material density of one or both of the rotors a counterbalance force may be generated without the use of counterweights on the rotors. It will be appreciated that material density may be varied on either of the first or second rotors without departing from the scope of the present disclosure. In some embodiments, material density may be varied on one rotor and not on the other rotor. Accordingly, the unequal distribution of mass in the longitudinal plane of supercharger 1100 may be asymmetrically distributed between the first and second rotors.

Furthermore, supercharger 1100 includes a synchronizing gear set 1110 that couples first and second rotors 1102 and 1104 to a crankshaft (not shown). In some embodiments, synchronizing gear set 1110 may include counterweights or may have a varied material density to provide a counterbalance force to reduce the inherent engine unbalance. For example, the synchronizing gears may include opposing counterweights similar to the configuration of supercharger 1000 to provide a planar couple. In another example, the synchronizing gears may include a counterweight or higher material density portion that may be combined with a corresponding counterweight or higher material density portion on an opposing end of a rotor to provide a rotation couple.

It will be appreciated that two or more of the above mass distribution arrangements may be combined in a supercharger to provide a counterbalance force to reduce engine imbalance. For example, a counterweight may be combined with a corresponding high material density portion. In another example, a supercharger may include a $1^{st}$ order couple and a $2^{nd}$ order couple. In another example, a supercharger may include a planar couple and a rotation couple. Note that changing the density of the rotors may include adding heavy metal to one side of the rotor with an insert or may include taking out weight of one side of the rotor with drillings, cut outs, etc.

Figure 12:
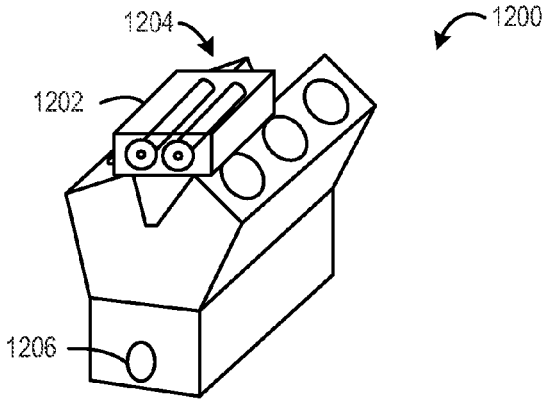
FIGS. 12-14 show different examples of a supercharger mounting position relative to an engine.
Figure 13:
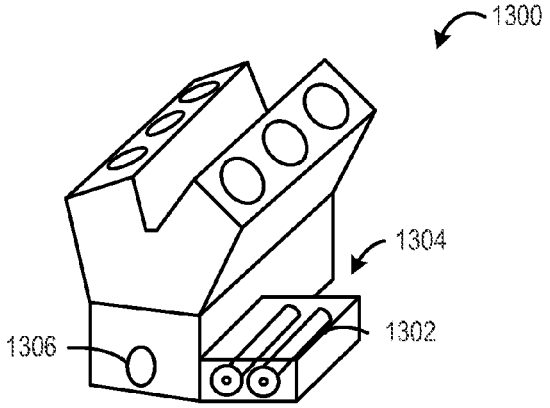
Figure 14:
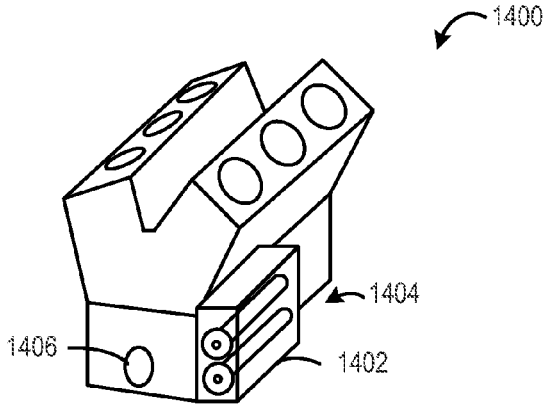

FIGS. 12-14 show different examples of a supercharger mounting position relative to an engine in order for the supercharger to provide a counterbalance to reduce engine unbalance. The supercharger shown in these examples includes two counter-rotating rotors, and an unequal distribution of mass along a longitudinal plane of the supercharger to provide a rotational counterbalance to reduce the inherent engine unbalance.

FIG. 12 shows a supercharger 1202 mounted on top or above an engine 1200. More particularly, supercharger 1202 may be mounted to a cylinder head of engine 1200. Supercharger 1202 is mounted in a horizontal arrangement where rotors 1204 are positioned horizontally coplanar relative to one another in what may be referred to as a "side-by-side" configuration. Rotors 1204 are positioned parallel to crankshaft 1206.

FIG. 13 shows a supercharger 1302 mounted horizontally on a side of an engine 1300. More particularly, supercharger 1302 may be positioned on a right or left side of engine 1300 so that rotors 1304 are parallel to crankshaft 1306. Supercharger 1302 is mounted in a horizontal arrangement where rotors 1304 are positioned horizontally coplanar relative to one another in a "side-by-side" configuration.

FIG. 14 shows a supercharger 1402 mounted vertically on a side of an engine 1400. More particularly, supercharger 1402 may be positioned on a right or left side of engine 1400 so that rotors 1404 are parallel to crankshaft 1406. Supercharger 1402 is mounted in a vertical arrangement where rotors 1404 are positioned vertically coplanar relative to one another in what may be referred to as an "over-under" configuration.

It will be appreciated that the above described superchargers and the associated couple or counterbalance forced provided by the superchargers can be applied anywhere on the engine as long as the rotors remain parallel to the crankshaft. In this way, the supercharger may provide greater engine packaging flexibility relative to a balance shaft system.

Figure 15:
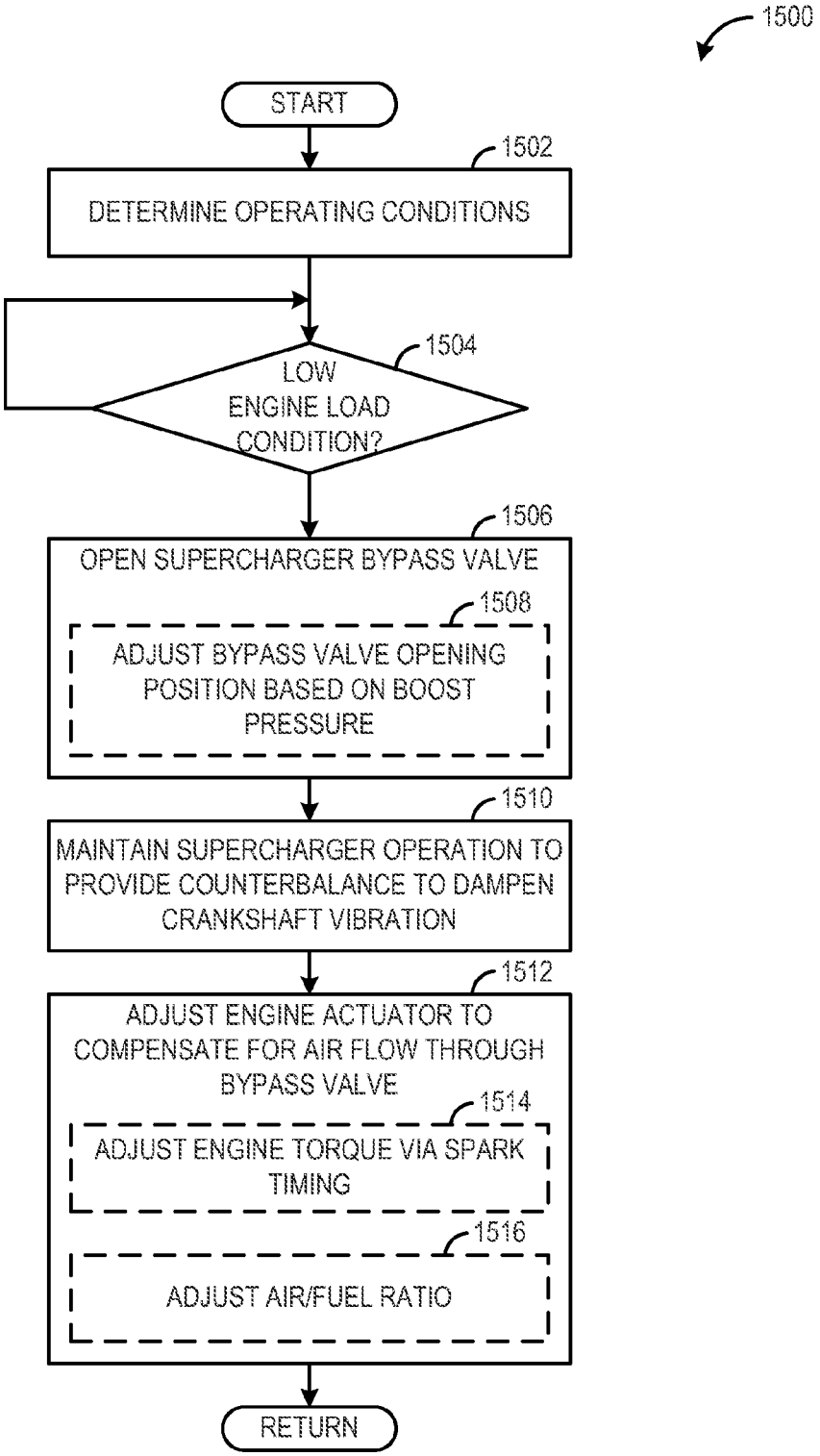
FIG. 15 shows a method for controlling an engine according to an embodiment of the present disclosure.

FIG. 15 shows a method 1500 for controlling an engine according to an embodiment of the present disclosure. In one example, method 1500 may be executed by controller 12 of FIG. 1. At 1502, method 1500 includes determining operating conditions. Determining operating conditions may include receiving signals from sensors indicative of various operating conditions, such as engine load, engine speed, boost pressure, air/fuel ratio, spark timing, bypass valve position, MAF, MAP, etc.

At 1504, method 1500 includes determining whether there is a low engine load condition. In one example, a low engine load condition may be determined based on a determined engine load being less than a threshold. A low engine load condition may include an engine idle condition, a light throttle cruising condition, etc. If it is determined that there is a low engine load condition, then method 1500 moves to 1506. Otherwise, method 1500 returns to 1504.

At 1506, method 1500 includes opening a bypass valve responsive to the low engine load condition to allow air to flow from a point downstream of a supercharger to a point upstream of the supercharger to lower boost pressure. In some embodiments, opening the bypass valve may include, at 1508, adjusting an opening position of the bypass valve to adjust a boost pressure downstream of the supercharger to a commanded pressure. In particular, the bypass valve may be adjusted to an open position that is between fully open and closed to vary the air flow through the bypass passage and correspondingly the boost pressure as commanded.

At 1510, method 1500 includes maintaining operation of the supercharger to provide the rotational counterbalance to reduce the inherent engine unbalance. In particular, operation of the supercharger includes rotation of the rotors to provide a rotation couple to counterbalance crankshaft vibration. In one example, the supercharger is coupled to the crankshaft such that the supercharger operates as long as the crankshaft is rotating. In other words, the supercharger need not be decoupled from the crankshaft via a clutch or other mechanism during the low engine load condition to lower boost pressure.

At 1512, method 1500 includes adjusting an engine actuator to compensate for air flow through the bypass valve. In some embodiments, at 1514, adjusting the engine actuator includes retarding a spark timing of an ignition system to adjust engine torque to compensate for the change in boost pressure relative to spark timing when the bypass valve is closed. For example, spark timing may be retarded to lower torque based on a lower air charge as a result of the reduced boost pressure.

In some embodiments, at 1516, adjusting the engine actuator includes adjusting an air/fuel ratio relative to an air/fuel ratio when the bypass valve is closed. For example, the air/fuel ratio may be adjusted to be leaner when the bypass valve is open because combustion temperatures may be lower as boost pressure is lowered, and there is less of a likelihood of engine knock. By adjusting one or more of the engine actuators to compensate for lower boost pressure when the bypass valve is opened, accurate control of air charge entering cylinders of the engine may be maintained.

The method may be performed to reduce pumping losses of the supercharger during a low load condition while still operating the supercharger to provide counterbalance functionality to reduce the inherent engine unbalance.

Note that the example control routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-3, V-8, and other engine types. Further, one or more of the various system configurations may be used in combination with one or more of the described diagnostic routines. The subject matter of the present disclosure includes all novel and nonobvious combinations and subcombinations of the various systems and configurations, and other features, functions, and/or properties disclosed herein.

The invention claimed is:

1. An engine comprising:

a piston operable to reciprocate in a cylinder according to a four stroke cycle;

a crankshaft rotatably coupled to the piston;

a supercharger rotatably coupled to the crankshaft, the supercharger having an unequal distribution of mass along a longitudinal plane of the supercharger, the supercharger being operable to produce a rotation couple that provides a rotational counterbalance to reduce engine imbalance, wherein the supercharger includes a first rotor and a second rotor in the longitudinal plane, the second rotor being operable to rotate in an opposite direction of the first rotor, the first and second rotors being parallel to the crankshaft, and wherein the first and second rotors rotate at a 2:1 ratio as the crankshaft to cause a 2nd order rotation couple;

a bypass passage fluidly coupled between a point downstream of the supercharger and a point upstream of the supercharger;

a bypass valve positioned in the bypass passage, the bypass valve being operable to selectively allow air to flow from the point downstream of the supercharger to the point upstream of the supercharger; and a controller including a processor and non-transitory computer readable medium having instructions that when executed by the processor:

open the bypass valve responsive to a low engine load condition while maintaining operation of the supercharger.

2. The engine of claim 1, wherein the supercharger includes a first counterweight and a second counterweight that opposes the first counterweight to provide the unequal distribution of mass.

3. The engine of claim 2, wherein the first and second counterweights are coupled to opposing ends of a same rotor to produce the rotation couple, and no counterweights are positioned on another rotor.

4. The engine of claim 2, wherein the first and second counterweights are coupled to opposing ends of different rotors to produce the rotation couple, and each rotor includes only one counterweight.

5. The engine of claim 2, wherein the supercharger includes a synchronizing gear set that couples the first and second rotors to the crankshaft, and the synchronizing gear set includes one or both of the first and second counterweights.

6. The engine of claim 1, wherein a material density of the first rotor or the second rotor is varied to provide the unequal distribution of mass.

7. The engine of claim 1, wherein the first and second rotors rotate at a 1:1 ratio as the crankshaft to cause a 1st order rotation couple.

8. An engine comprising:

a cylinder;

a crankshaft rotatably coupled to the cylinder;

a supercharger rotatably coupled to the crankshaft, the supercharger including a first rotor and a second rotor operable to rotate in an opposite direction of the first rotor, and a first counterweight and a second counterweight that opposes the first counterweight, the supercharger being operable to produce a rotation couple that provides a rotating counterbalance to reduce engine imbalance;

a bypass passage fluidly coupled between a point downstream of the supercharger and a point upstream of the supercharger;

a bypass valve positioned in the bypass passage, the bypass valve being operable to selectively allow air to flow from the point downstream of the supercharger to the point upstream of the supercharger; and a controller including a processor and non-transitory computer readable medium having instructions that when executed by the processor:

open the bypass valve responsive to an engine idle condition while maintaining operation of the supercharger; and adjust an engine air-fuel ratio to be leaner relative to an air-fuel ratio when the bypass valve is closed to compensate for air flow through the bypass valve.

9. The engine of claim 8, wherein the first and second counterweights are coupled to opposing ends of a same rotor to produce the rotation couple, and no counterweights are positioned on another rotor.

10. The engine of claim 8, wherein the first and second counterweights are coupled to opposing ends of different rotors to produce the rotation couple, and each rotor includes only one counterweight.

11. The engine of claim 8, wherein the supercharger includes a synchronizing gear set that couples the first and second rotors to the crankshaft, and the synchronizing gear set includes the first and second counterweights.

12. The engine of claim 8, wherein the first and second rotors rotate at a 1:1 ratio as the crankshaft to cause a 1st order rotation couple.

13. The engine of claim 8, wherein the first and second rotors rotate at a 2:1 ratio as the crankshaft to cause a 2nd order rotation couple.

14. A method for controlling an engine comprising:

operating a supercharger having an unequal distribution of mass along a longitudinal plane of the supercharger to produce a rotation couple that provides a rotational counterbalance to reduce engine imbalance;

opening a bypass valve responsive to an engine idle condition to allow air to flow from a point downstream of the supercharger to a point upstream of the supercharger to lower boost pressure while maintaining operation of the supercharger to provide the rotational counterbalance to reduce engine imbalance, the engine operating according to a four stroke cycle; and adjust an engine air-fuel ratio to be leaner relative to an air-fuel ratio when the bypass valve is closed to compensate for air flow through the bypass valve.

15. The method of claim 14, further comprising:

varying an opening position of the bypass valve to adjust a boost pressure downstream of the supercharger to a commanded pressure.

* * * * *